US012178338B1

(12) United States Patent
Huang

(10) Patent No.: US 12,178,338 B1
(45) Date of Patent: Dec. 31, 2024

(54) CUP COVER WITH TWO DRINKING SPOUTS AND DRINKING UTENSIL CONTAINING SUCH CUP COVER

(71) Applicant: Guangdong Musen Daily Products Co., Ltd., Yangjiang (CN)

(72) Inventor: SiHua Huang, Yangjiang (CN)

(73) Assignee: Guangdong Musen Daily Products Co., Ltd., Yangjiang (CN)

( * ) Notice: Subject to any disclaimer, the term of this patent is extended or adjusted under 35 U.S.C. 154(b) by 0 days.

(21) Appl. No.: 18/129,899

(22) Filed: Apr. 3, 2023

(30) Foreign Application Priority Data

Sep. 19, 2022 (CN) ..... 202211135796.2

(51) Int. Cl.
*A47G 19/22* (2006.01)

(52) U.S. Cl.
CPC ..... *A47G 19/2272* (2013.01)

(58) Field of Classification Search
CPC ..... A47G 19/2205; A47G 19/2266; A47G 19/2272; B65D 25/46; B65D 47/06; B65D 47/061; B65D 47/065; B65D 47/088; B65D 47/0885
USPC ..... 220/705, 707, 711, 713
See application file for complete search history.

(56) References Cited

U.S. PATENT DOCUMENTS 10,159,368 B2 * 12/2018 Lin ..... B65D 43/16
11,426,017 B2 * 8/2022 Chan ..... A47G 19/2272
11,479,390 B1 * 10/2022 Salvador-Zamora ..... B65D 47/0857
11,639,253 B2 * 5/2023 Swartz ..... B65D 47/0885 220/705
2017/0341828 A1 * 11/2017 Balkus ..... B65D 47/065
2021/0086960 A1 * 3/2021 Wang ..... B65D 25/46

* cited by examiner

*Primary Examiner* — Nathan J Jenness
*Assistant Examiner* — Madison L Poos
(74) *Attorney, Agent, or Firm* — Shen Huang

(57) ABSTRACT

The present invention discloses a cup lid with double drinking mouth, including covering the body and drinking mouth. On the container, the cover body has the first central line set parallel to the container depth direction; drinking mouth two, on the other side of the first center line, and stay away from Drinking One. First, the cover body has a diversion channel two that penetrates the body of the body, which is formed by the Drinking Channel two for the drinking passage of the container when the diversion channel one and the diversion channel two are connected. There is a barrier block on one side, and the relative side of the other side is provided with an operating parts that drives the mouth of driving the mouth on the cover or relative to the cap. When the upper part of the body is, the lower end of the derivation channel is separated from the upper end of the Digital Channel 2 from the upper end of the Directorial Channel II. Thin, the second state of drinking is forming a closed state. The cup lid has two types of drinking mouths, which can be used in various occasions. At the same time, when choosing to drink the mouth two, the suction mouth is non-contact connection with the below. It can also be used from time to time, which brings great convenience to use.

14 Claims, 9 Drawing Sheets

CUP COVER WITH TWO DRINKING SPOUTS AND DRINKING UTENSIL CONTAINING SUCH CUP COVER

FIELD OF TECHNOLOGY

The invention involves the field of cups, especially involves the cup cover with two drinking spouts and drinking utensil containing such cup cover.

BACKGROUND

Water cup refers to a container used in people's daily life, which is mainly used to drink tea, water, coffee, drinks and other beverages. Materials such as plastic, glass, porcelain or stainless steel are usually made of materials. Among them, one-time water cups are commonly used in paper cups or rubber cups. The cup body is generally cylindrical, open on top, hollow for prosperity.

For commonly used water cups, the corresponding cup lid must be configured. The common cup lid has a drinking water mouth, but most of the existing technologies have a single drinking water mouth, which cannot meet more occasions, such as for time for time High requirements, such as in parent-child relationships, such as quickly solve drinking in exercise occasions, so one cup lid sets two drinking methods is particularly necessary, especially for drinking of the straw mouth, which is particularly necessary for drinking.

SUMMARY

For the shortcomings of the existing technology, the present invention provides a cup lid with double drinking mouth. It has two types of drinking mouths and can be used in various occasions. At the same time, when choosing a mouthful of drinking, the suction mouth and the below are right and wrong. In contact connection, the suction mouth can be greatly adjusted to the required angle to adapt to the container that it can be used when it is not inclined, which brings great convenience to use.

In order to solve the above technical problems, the present invention can be solved through the following technical solutions:

In the present invention, the cup cover with two drinking spouts, comprising: a cover body provided with a cover body part and a combination part extending from the cover body part, wherein the cover body is detachably disposed on a container through the combination part, and the cover body has a first centerline parallel to a depth direction of the container:

a first drinking spout extending outward along a top of the cover body part and located on one side of the first centerline, wherein the first drinking spout is provided with a first drinking channel through which a beverage in the container flows, the first drinking channel runs through the cover body part and communicates with the container, the first drinking spout is provided with a detachably connected drinking spout cover configured for opening or closing the first drinking channel; and a second drinking spout, located at the other side of the first centerline, far away from the first drinking spout, wherein the second drinking spout is provided with a first conduit channel, the cover body is provided with a second conduit channel running through the cover body part, and the first conduit channel and the second conduit channel, when communicating with each other, form a second drinking channel through which the beverage in the container flows: the second drinking spout has one side provided with a barrier block and the corresponding other side provided with an operating member that drives the second drinking spout to press on the cover body or to be separated from the cover body; and when the second drinking spout rotates with respect to the cover body until the second drinking spout abuts against an upper part of the cover body part, a lower end of the first conduit channel is far away from an upper end of the second conduit channel, being spaced apart from the second conduit channel, the barrier block abuts against an upper part of the second conduit channel, the second conduit channel does not allow flow; and therefore the second drinking spout is in a closed state.

In the present invention, there are also technical solutions, wherein the suction nozzle has a first suction nozzle end face and a second suction nozzle end face that are opposite each other, the suction nozzle cover when closed is located on the first suction nozzle end face, the barrier block has a first barrier end surface and a second barrier end surface that are connected through a curved transition, the second barrier end surface of the barrier block and the second suction nozzle end face are located on a same side, and a highest point of the second barrier end surface is located on a different horizontal plane from the second suction nozzle end face and protrudes from the second suction nozzle end face; and the second suction nozzle end face is of a curved structure.

In the present invention, there are also technical solutions, wherein the rotating member is provided with a first through hole, the first through hole running through the rotating member from a first barrier end surface along a length direction of the suction nozzle, and the suction nozzle is provided with a second through hole, wherein the first through hole and the second through hole form the first conduit channel, and the first through hole has a water inlet end in communication with the second conduit channel and a water outlet end in communication with the second through hole.

In the present invention, there are also technical solutions, wherein a diameter of the second through hole is configured greater than or equal to a diameter of the first through hole; and, the diameter of the second through hole is configured greater than or equal to a diameter of the second conduit channel.

In the present invention, there are also technical solutions, wherein when the second drinking channel allows or does not allow flow, centers of the first through hole and the second through hole are on a same straight line.

In the present invention, there are also technical solutions, wherein the rotating member is disposed on a top wall of the cover body part away from the first centerline, the suction nozzle cover is disposed on the rotating member and pivotally connected to the rotating member, and when a force is applied to the operating member, the rotating member, suction nozzle cover, and suction nozzle are moved as a whole from a mounting chamber.

In the present invention, there are also technical solutions, wherein the operating member is disposed on a top of the rotating member and extends from a body of the rotating member to form a bump structure, and the operating member is located on a side away from the suction nozzle; and, when the suction nozzle cover covers the suction nozzle, a tail end part of the operating member protrudes from an outer wall of the cover body and is located outside the cover body.

In the present invention, there are also technical solutions, wherein an outer peripheral surface of the cover body part has a curved part, and an outer tail end of the operating member is configured as a circular curved extension part, the extension part and the curved part being basically on a same curve line.

In the present invention, there are also technical solutions, wherein a lower end surface of the operating member is provided with a limit block, an outer wall of the cover body part is formed with a limit region, and when the second drinking channel is configured to allow the beverage in the container to flow; the rotating member abuts against a limit end face of the limit region through the limit block which is configured to limit continuous rotation of the rotating member in a direction of a first center.

In the present invention, there are also technical solutions, wherein the limit region is a region concaved inward from the cover body, an outer end face of the limit region forms a limit end face, and the limit end face is disposed parallel to the first centerline; and an outer end of the limit block has a plane fitting the limit end face.

In the present invention, there are also technical solutions, wherein the top of the cover body part is provided with a mounting chamber configured for mounting and accommodating the second drinking spout, the mounting chamber has a tilting ramp and is provided with a limit end and a free end, the limit end being higher than the free end, and the free end of the mounting chamber runs through an outer end of the cover body part; and a free space is formed between the free end and the mounting end surface of the mounting chamber and taken as a movement path required by the rotation of the barrier block and the operating member when the suction nozzle is covered and opened.

In the present invention, there are also technical solutions, wherein the second drinking spout is provided with an absorption structure, the absorption structure extends along an outer end face of the rotating member, the outer end face of the absorption structure is configured as a planar structure fitting an end surface of a first drinking spout cover and configured for placement of the first drinking spout cover when the first drinking spout cover is separated from the drinking spout.

In the present invention, there are also technical solutions, wherein the absorption structure is configured as a magnetic member, the second drinking spout is provided with a first mounting chamber configured for mounting the magnetic member, and the outer end face of the absorption structure is close to the magnetic member and is capable of allowing a structure on the outer end face to sense an attracting force.

In the present invention, there are also technical solutions, wherein an outer end face of the first drinking spout cover is configured as a planar structure fitting an end surface of the absorption structure, an upper part of the first drinking spout cover close to a top surface is provided with a second mounting chamber configured for mounting the magnetic member, and the outer end face of the first drinking spout cover is close to the magnetic member and is capable of allowing a structure on the outer end face to sense an attracting force.

In the present invention, there are also technical solutions, the cup cover with two spouts for a drinking utensil, comprising:

a cover body provided with a cover body part and a combination part extending from the cover body part, wherein the cover body is detachably disposed on a container through the combination part, and the cover body has a first centerline parallel to a depth direction of the container:

a first drinking spout extending outward along a top of the cover body part and located on one side of the first centerline, wherein the first drinking spout is provided with a first drinking channel through which a beverage in the container flows, the first drinking channel runs through the cover body part and communicates with the container, the first drinking spout is provided with a detachably connected drinking spout cover configured for opening or closing the first drinking channel; and a second drinking spout, located at the other side of the first centerline, far away from the first drinking spout, wherein the second drinking spout is provided with a first conduit channel, the cover body is provided with a second conduit channel running through the cover body part, and the first conduit channel and the second conduit channel, when communicating with each other, form a second drinking channel through which the beverage in the container flows: the second drinking spout has one side provided with a barrier block and the corresponding other side provided with an operating member that drives the second drinking spout to press on the cover body or to be separated from the cover body; and when the second drinking spout rotates with respect to the cover body until the second drinking spout abuts against an upper part of the cover body part, a lower end of the first conduit channel is far away from an upper end of the second conduit channel, being spaced apart from the second conduit channel, the barrier block abuts against an upper part of the second conduit channel, the second conduit channel does not allow flow; and therefore the second drinking spout is in a closed state; and a straw detachably connected to a lower end of the second conduit channel, the straw being in non-contact communication with or disconnection from the first conduit channel of the second drinking spout.

In the present invention, there are also technical solutions, the drinking utensil, comprising:

the cup cover according to any one of the above cup lid technical solutions, and, a container configured to hold a beverage, wherein the cup cover is detachably connected to the container; and a drinking spout cover comprises an inner cover and an outer cover, wherein the second mounting chamber is formed between the inner cover and the outer cover and is configured for mounting and positioning the second magnetic member, and a top end of the second magnetic member close to the outer cover forms an absorption combination surface; and the inner cover and the outer cover are provided with a cavity combination region, when the drinking spout cover is combined with the first drinking spout, the inner cover is located in a channel of the first drinking spout, that is, the first drinking channel, the outer cover is sleeved on an outer wall of the first drinking spout and is combined with the first drinking spout, and the cavity combination region accommodates and surrounds the body of the first drinking spout, such that the first drinking spout is sealed completely.

The cup lid of the present invention and the drinking utensils set up the lid have two types of drinking mouths, and can be used in various occasions. At the same time, when choosing to drink the mouth two, the suction mouth is non-contact connection with the beeper below: The required angle is greatly adjusted to adapt to the container that it can also be used when it is not tilted, which brings great convenience to use, especially the occasions required for exercise.

The additional and advantages of the present invention will be given part in the description below; and the part will be obvious from the description below; or it will be learned through the practice of the present invention.

DESCRIPTION OF THE EMBODIMENTS

Figure 1:
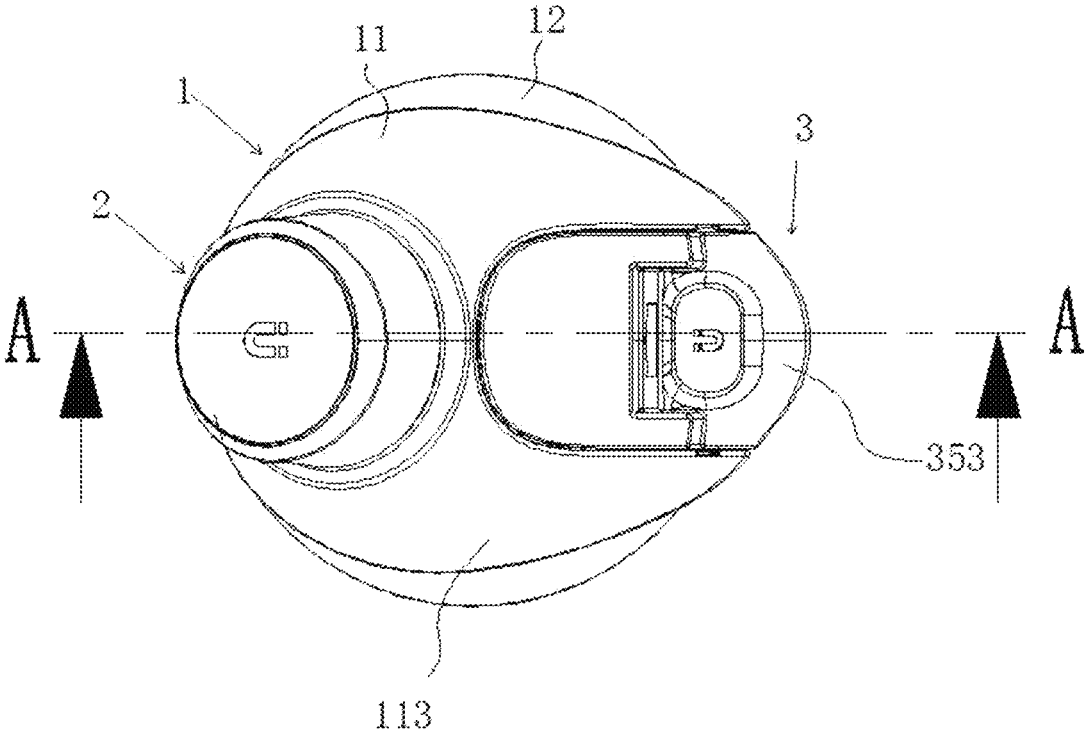
FIG. 1 is a front view of a closed second drinking spout of a cup with two drinking spouts according to an embodiment of the present invention.
Figure 2:
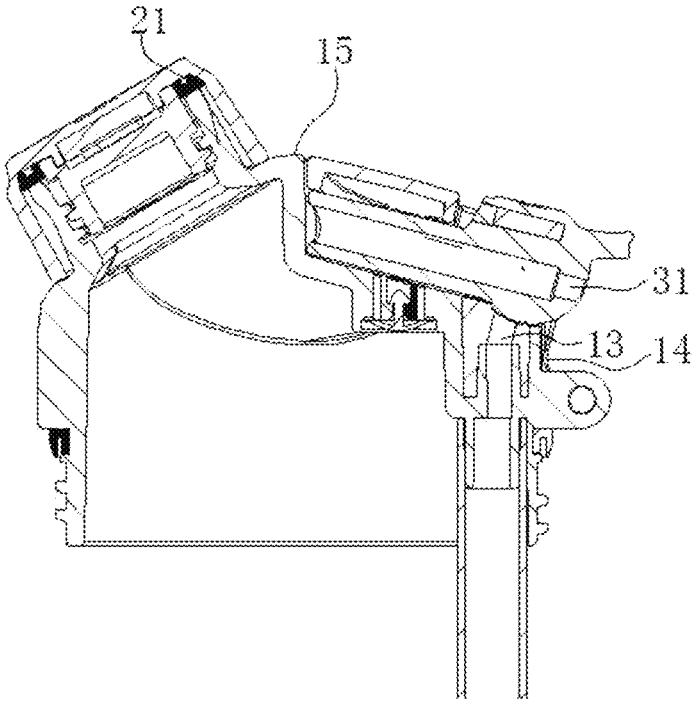
FIG. 2 is a cross-sectional view in FIG. 1 taken along A-A.
Figure 3:
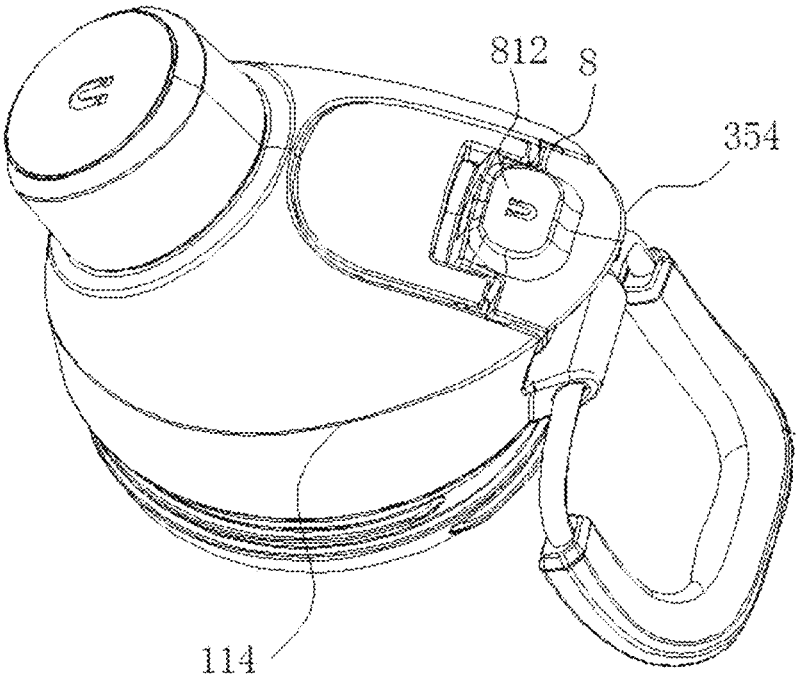
FIG. 3 is a schematic structural diagram of a closed cup cover with two drinking spouts according to an embodiment of the present invention.
Figure 4:
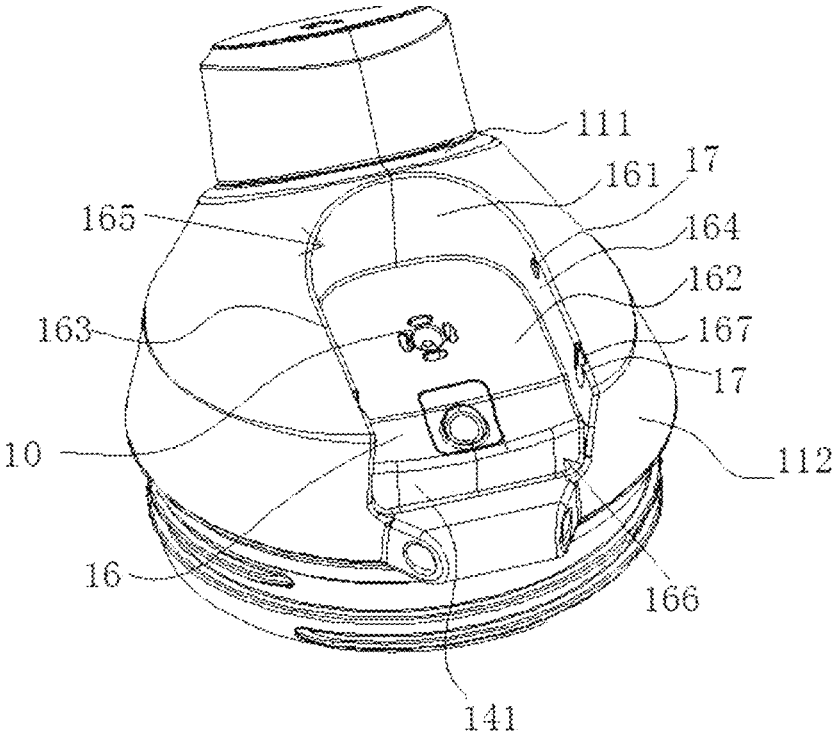
FIG. 4 is a schematic structural diagram of a cover body according to an embodiment of the present invention.
Figure 5:
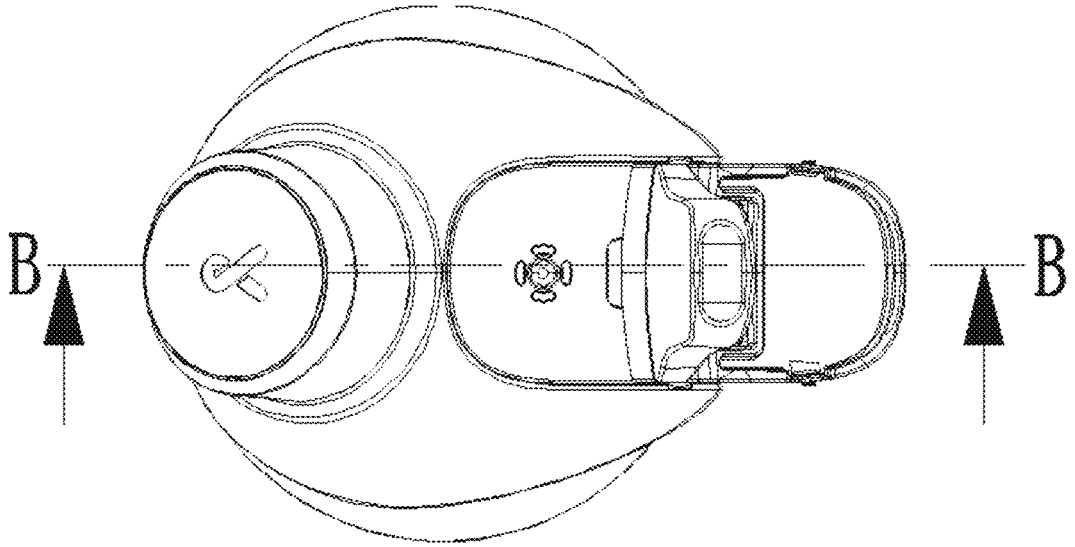
FIG. 5 is a front view of an opened second drinking spout of a cup with two drinking spouts according to an embodiment of the present invention.
Figure 6:
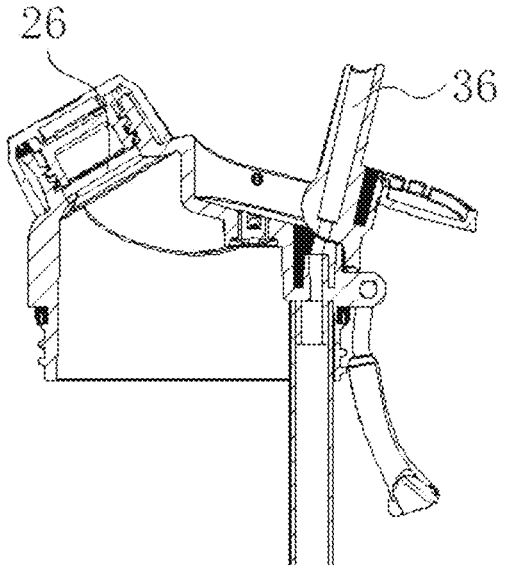
FIG. 6 is a cross-sectional view in FIG. 5 taken along B-B.
Figure 7:
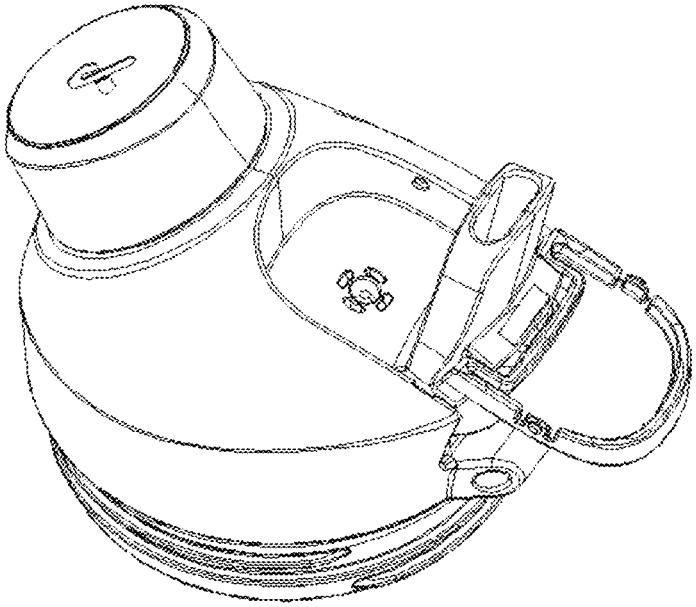
FIG. 7 is a schematic structural diagram of an opened second drinking spout of a cup with two drinking spouts according to an embodiment of the present invention.
Figure 8:
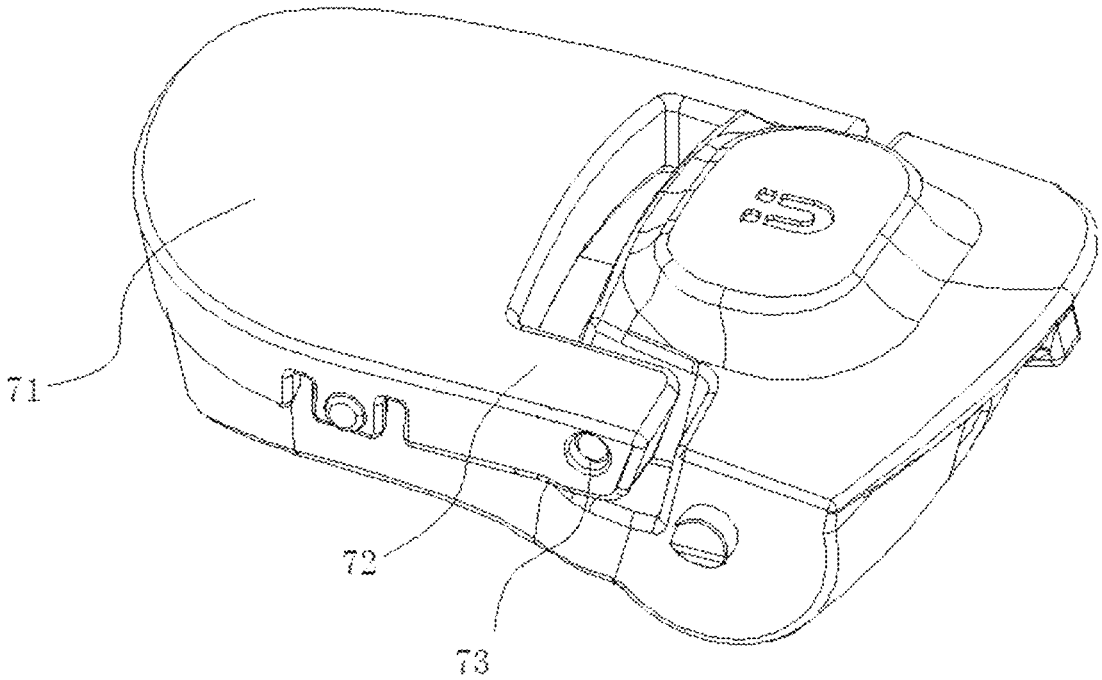
FIG. 8 is a schematic structural diagram of a closed second drinking spout according to an embodiment of the present invention.
Figure 9:
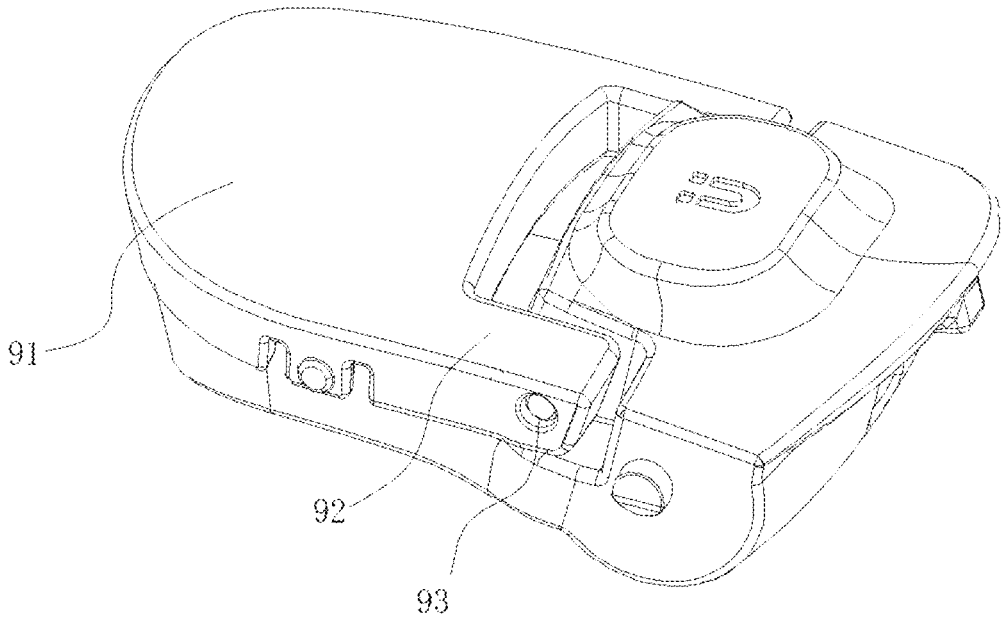
FIG. 9 is a schematic structural diagram of a second drinking spout without a suction nozzle cover according to an embodiment of the present invention.
Figure 10:
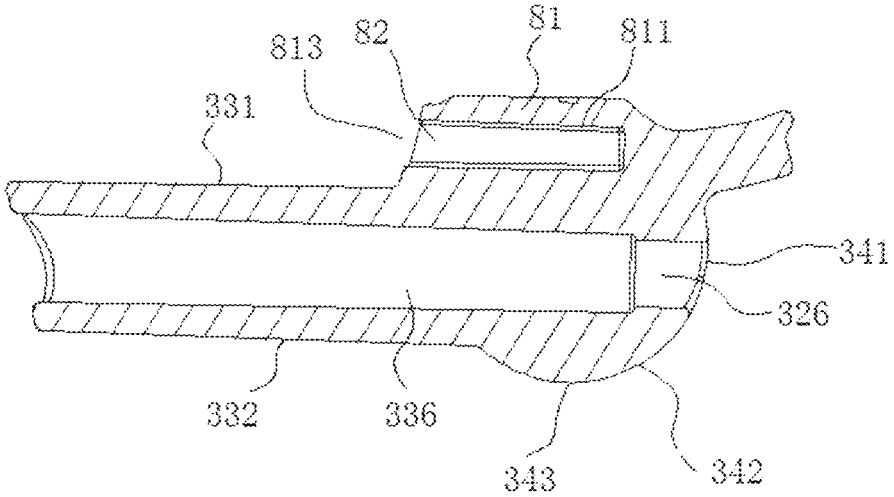
FIG. 10 is a cross-sectional view of a second drinking spout without a suction nozzle cover according to an embodiment of the present invention.

In order to make the purpose, technical solution and advantages of the implementation of the invention more clearly, the following will be combined with the drawings of the implementation of the invention to clearly and complete the technical scheme of the embodiments of the invention. Obviously, the embodiment described is a part of the implementation of the present invention, not all the embodiments. Based on the embodiments of the invention described, all the other embodiments obtained by ordinary technical personnel in the art on the premise that they do not need creative labor are the scope of the protection of the invention.

In the present invention, unless there are other clear rules and limits, the first feature in the second feature of the second feature can include the first and second features directly contact, or the first and second features It's not direct contact but through other feature contact between them. Moreover, the first feature is above and "above", "above", and "above" include the first feature of the second characteristic above and above, or only indicates that the first feature level is higher than the second feature. The first feature is "below", "below", and "below", including the first characteristics of the first characteristic below and below the second feature, or only indicate that the first feature level height is less than the second feature.

As shown in FIGS. 1 to 18, according to the embodiments of the present invention, a cup cover with two drinking spouts is provided including a cover body 1, a first drinking spout 2, and a second drinking spout 3. The first drinking spout 2 is provided with a first drinking channel 26 (one drinking spout), and the second drinking spout 3 is provided with a second drinking channel 36 (the other drinking spout), such that the beverage in a container 200 is sucked optionally in a maximum range, thus adapting to the requirements of different scenarios.

In this embodiment, a cover body 1 is provided with a cover body part 11 and a combination part 12 extending from the cover body part 11, where the cover body 1 is detachably disposed on a container 200 through the combination part 12. When the combination part 12 has an internal thread, a corresponding upper part of the container 200 has an external thread, and when the combination part 12 has an external thread, the corresponding upper part of container 200 has an internal thread. This facilitates the combination and disassembly between the cover body and the container 200, and does not limit the connection of threads. Other disassembly and connection manners such as buckling are applicable to disassembly and connection of the cover body 1 and container 200 in this embodiment. The cover body 1 in this embodiment has a first centerline 4, that is, a first centerline 4 located at a positive center of the cover body 1, and the container 200 also has a second centerline 5 parallel to the depth direction of the container 200, the first centerline 4 being parallel to the second centerline 5. The first drinking nozzle 2 and the second drinking spout 3 in this embodiment are disposed on two sides of the first centerline 4 or second centerline 5, respectively, facilitating selection and use of the first drinking spout 2 and the second drinking spout 3.

In this embodiment, the first drinking spout 2 extends outward along a top of the cover body part 11 and is located on one side of the first centerline 4. The first drinking spout 2 is provided with a first drinking channel 26 through which a beverage in the container 200 flows, the first drinking channel 26 runs through the cover body part 11 and communicates with the container 200, such that the beverage in the container 200 flows out. The first drinking spout 2 is provided with a detachably connected drinking spout cover 7 configured for opening or closing the first drinking channel 26. When the user wants to drink the beverage in the container 200, the beverage can flow out of the first drinking spout 2 of the first drinking channel 26 by pouring and opening the drinking spout cover 7. The first drinking spout 2 of this embodiment is disposed at an inclined angle to the first centerline 4 or to the cover body part 11 and is inclined in a direction close to the outer wall 14 of the cover body 1, thus facilitating suction by the user.

According to this embodiment of the present invention, the drinking spout cover 7 can be disassembled and moved to other positions relative to the first drinking spout 2. In the prior art, generally, the user unscrews the drinking spout cover 7 and holds it in one hand, and then drinks the beverage in the container 200 through the first drinking spout 2. However, the drinking spout cover 7 being held in hand is likely to fall onto the ground and get dirty, and even rolls to other places where it cannot be picked up easily, and thus is lost, losing the use value of the container 200. The first drinking spout 2 is likely to get dirty by, for example, dusts, and the dusts enter the container 200 through the first drinking channel 26, contaminating the beverage in the container 200, and causing the beverage to be undrinkable. In addition, the first drinking spout 2 cannot be sealed, causing the beverage to leak from the first drinking channel 26, thus making the container 200 inconvenient to carry. Therefore, in the solution of this embodiment, the drinking spout cover 7 can be placed on the cover body 1, thus resolving the foregoing deflects. The drinking spout cover 7 is adsorbed on the cover body 1 by a magnetic structure provided on the drinking spout cover 7, preferably, on the second drinking spout 3 on the other side of the first centerline 4. Because the positions of the first drinking spout 2 and the second drinking spout 3 are arranged opposite each other, the drinking spout cover 7 does not affect the use of the first drinking spout 2 or the second drinking spout 3 when being placed in the corresponding position of the second drinking spout 3. Because the drinking spout cover 7 is adsorbed on the suction nozzle cover 9 or a rotating member 32, away from the direction of the first drinking spout 2, the drinking path of the first drinking spout 2 is not interfered with when used.

According to an embodiment of the present invention, the second drinking spout 3 is located on the other side of the first centerline 4 and away from the first drinking spout 2. The second drinking spout 3 is inclined when used for drinking the beverage in the container 200, is also inclined to the cover body part 11, and is inclined in the direction of the outer wall 14 of the cover body 1, which facilitates the drinking by the user. The preferred solution is that the straw 300 of the second drinking spout 3 is partially or completely suspended outside relative to the outer wall 14 of the cover body 1. In this way, when the container 200 is placed flat on a table or table-like medium, it is also possible to drink the beverage in the container 200 through the second drinking spout 3. Comparatively, in the prior art, the container 200 needs to be inclined at a specific angle with respect to the mouth of the user, such that the mouth can reach the upper part of the second drinking spout 3 to drink the beverage in the container 200. Compared with the prior art, the position and structure of the second drinking spout 3 of the present invention are provided to allow users to drink the beverage in the container 200 better and more conveniently at angles on different scenarios. In this embodiment, the second drinking spout 3 is provided with a first conduit channel 31. The cover body 1 is provided with a second conduit channel 13 running through the cover body part 11. The first conduit channel 31 and the second conduit channel 13, when communicating with each other, form a second drinking channel 36 through which the beverage in the container 200 flows. When the second drinking spout 3 is covered by the suction nozzle cover 9 or the second drinking spout 3 is opened or closed, the first conduit channel 31 is basically disconnected from the second conduit channel 13, that is, the upper end of the second conduit channel 13 and the lower end of the first conduit channel 31 are not located in the same position for communication. The second drinking spout 3 in this embodiment has one side provided with a barrier block 34 and the corresponding other side provided with an operating member 35 that drives the second drinking spout 3 to press on the cover body 1 or to be separated from the cover body 1. Using the orientation shown in FIG. 2 as an example, when the second drinking spout 3 is closed, the barrier block 34 is located below the rotating member, and the operating member 35 is located above the rotating member, that is, both are arranged in opposite directions. When the second drinking spout 3 rotates with respect to the cover body 1 until the second drinking spout 3 abuts against an upper part of the cover body part 11, a lower end of the first conduit channel 31 is far away from an upper end of the second conduit channel 13, being spaced apart from the second conduit channel 13, the barrier block 34 abuts against an upper part of the second conduit channel 13, the second conduit channel 13 does not allow flow; and the beverage in the container 200 cannot flow into the second drinking spout 3 through the conduit channel. Thus, the corresponding second drinking spout 3 is in a closed state, that is, the state in which no beverage flows through the first conduit channel 31, and a state in which the second drinking channel 36 is not used. A center line of the second conduit channel 13, in this embodiment, parallel to the first centerline 4, is defined as the third centerline 6, where the third centerline 6 is also located at the central position of the second conduit channel 13.

According to this embodiment of the present invention, when the barrier block 34 is moved for the connection between the first conduit channel 31 and the second conduit channel 13, the second drinking spout 3 can be used to drink the beverage in the container 200; otherwise when the barrier block 34 abuts against the second conduit channel 13, the second drinking spout cannot be used for drinking. Therefore, the barrier block 34 of this embodiment plays a leading role for closing or opening the second drinking spout 3, which is the key technology in the present invention, so as to switch the use and non-use states of the second drinking spout 3. Such a structure allows for a larger inclined angle for the second drinking spout 3, such that the user does not need to tilt the container 200 for drinking the beverage in the container 200 through the second drinking spout 3. The second drinking spout 3 in this embodiment includes a rotating member 32 and a suction nozzle 33, where a suction nozzle cover 9 configured to cover the entire suction nozzle 33 is disposed above the suction nozzle 33, the barrier block 34 is disposed on the rotating member 32 and is located on a side away from the suction nozzle cover 9, the second drinking spout 3 and the suction nozzle cover 9 are capable of rotating as a whole with respect to the cover body 1. The second drinking spout and the suction nozzle cover rotate until the lower end of the first conduit channel 31 communicates with the upper end of the second conduit channel 13, such that the beverage in the container 200 flows. When the second drinking channel 36 allows the beverage in the container 200 to flow; the barrier block 34 is partially or completely located on an inner side of the third centerline 6. That is, the barrier block 34 rotates beyond the inner side of the third centerline 6. In this case, the nozzle 33 is arranged at an angle to the first centerline 4 or the third centerline 6 and the nozzle 33 is located outside the third centerline 6 and close to the outer wall 14 of the cover body 1. Preferably, the suction nozzle 33 is located outside the outer wall 14, facilitating the drinking operation with no need to tilt the container 200.

According to this embodiment of the present invention, the rotating member 32 is disposed on the top wall 15 of the cover body part 11, being far away from the first centerline 4, and pivotally connected to the top wall 15 of the cover body portion 11 and rotates relative to the cover body portion 11. The rotating member 32 is provided with a first through hole 326, the first through hole 326 running through the rotating member 32 from a first barrier end surface 341 along a length direction of the suction nozzle 33, and the suction nozzle 33 is provided with a second through hole 336. The first through hole 326 and the second through hole 336 form the first conduit channel 31, and the first through hole 326 has a water inlet end in communication with the second conduit channel 13 and a water outlet end in communication with the second through hole 336. When the second drinking channel 36 allows or does not allow flow; centers of the first through hole 326 and the second through hole 336 are on a same straight line. In this embodiment, preferably, a diameter of the second through hole 336 is configured greater than or equal to a diameter of the first through hole 326; and the diameter of the second through hole 336 is configured greater than or equal to a diameter of the second conduit channel 13, facilitating the adjustment of the speed and flow rate of the beverage in the container 200.

In this embodiment, the top of the cover body part 11 is provided with a mounting chamber 16 configured for mounting and accommodating the second drinking spout 3. The mounting chamber 16 is of a structure concaved relative to the top wall of the cover body part 11, thereby accommodating the second drinking spout 3. The top wall of the cover body part 11 is provided with a first upper part 111 and a first lower part 112. The mounting chamber 16 is inclined from the first upper part 111 to the first lower part 112, to form an inclined surface. In addition, the mounting chamber 16 and the cover body part 11 are provided with a limit end face 161, a placement end surface 162, a first side end surface 163, and a second side end surface 164. The mounting chamber 16 is further provided with a limit end 165 and a free end 166. Part of the limit end 165 close to the first upper part 111 and the top wall form a limit end face 161. The first side end surface 163 and the second side end surface 164 are respectively located on two sides of the limit end face 161 and are both connected to the limit end face 161. An end opposite to the limit end 165 is disposed as a free end 166. The free end 166 of the mounting chamber 16 in this embodiment runs through the outer wall 14 of the cover body part 11, to communicate with the outside, thus facilitating the movement path of the second drinking spout 3 during rotation, that is, the movement path required by the barrier block 34 and the operating member 35 during rotation when the suction nozzle 33 is closed or opened. When the suction nozzle cover 9 is completely located in the mounting chamber 16, the front end of the suction nozzle cover 9 abuts against the limit end face 161 or is at a certain distance from it, ensuring that the entire second drinking spout 3 is positioned on the cover body part 11 when being unused.

In this embodiment, the top wall of the cover body part 11 is further provided with first mounting holes 17 for connecting the rotating member 32. The first mounting holes 17 are respectively disposed on the first side end surface 163 and the second side end surface 164, and run into the cover body part 11 from the two side end surfaces. The rotating member 32 is pivotally connected to the cover body portion 11 through a first rotating member 18. The first rotation shaft 18 may be of an independent structure that runs through the corresponding second mounting hole 322 on the rotating member 32 to be connected to the first mounting hole 17 on the cover body part 11. The rotating member 32 can rotate with respect to the cover body part through the rotation shaft. Alternatively, a part of the rotating member 32 extends outward to form a protruding columnar structure, that is, the first rotation shaft. The rotating member 32 runs into the first mounting hole 17 through the protruding columnar structure for rotatable connection. The rotating member 32 can also rotate with respect to the cover body through the shaft rotation, which falls into the protection scope of this embodiment.

An adjustment region 167 is provided on the upper part of the first mounting hole 17. The adjustment regions 167 are wedge-shaped structures formed at the first mounting holes 17 on the first side end surface 163 and the second side end surface 164 and concaved upward along the top wall. The adjustment region 167 is concaved inward and gets larger at the mounting hole 17 with a gradually increased depth, such that the part in the second drinking spout 3 is taken out upward as a whole from the mounting chamber 16. With the outside depth being increasingly large, it is more conveniently to take out the second drinking spout 3. When it is mounted in the first mounting hole 17, with the depth being increasingly small, the parts in the second drinking spout 3 is mounted as a whole more stably. In this embodiment, the first mounting hole 17 is directly provided on the cover body part 11, which is simple in structure and easy to mount.

In this embodiment, the second conduit channel 13 runs through the top wall of the cover body 1 and the placement end surface 162. An outer end face of the water outlet at the upper end of the second conduit channel 13 protrudes from the placement end surface 162 or is flush with the placement end surface 162.

According to this embodiment of the present invention, the suction nozzle 33 is provided with a first suction nozzle end face 331 and a second suction nozzle end face 332 that are opposite each other. The suction nozzle cover 9 is disposed at the orientation of the first suction nozzle end face 331. When the suction nozzle 33 abuts against the top wall of the cover body part 11, the suction nozzle cover 9 covers the suction nozzle 33 and is located on the first suction nozzle end face 331 when completely covering the suction nozzle 33, and the second suction nozzle end face 332 is located below the suction nozzle 33 and basically abuts against the placement end surface 162 of the top wall of the cover body part 11. In this embodiment, when the suction nozzle cover 9 approaches the first suction nozzle end face 331, the suction nozzle 33 is closed, and when the suction nozzle cover 9 leaves the first suction nozzle end face 331, the suction nozzle 33 is opened. When the suction nozzle cover 9 is disposed on the rotating member 32 and pivotally connected to the rotating member 32, and a force is applied to the operating member 35, the rotating member 32, the suction nozzle cover 9, and the suction nozzle 33 are removed as a whole from the mounting chamber 16, and get away from the placement end surface 162 of the mounting chamber 16, thus opening the second drinking spout 3, and implementing the drinking function of the second drinking channel 36.

In this embodiment, the barrier block 34 is disposed on the rotating member 32 and located below the rotating member 32, the suction nozzle 33 is located on one side of the rotating member 32 corresponding to a side away from the suction nozzle 33 on which the barrier block 34 is located. The barrier block 34 has a first barrier end surface 341 and a second barrier end surface 342 that are connected through a curved transition. The second barrier end surface 342 of the barrier block 34 and the second suction nozzle end face 332 are located on a same side. A highest point 343 of the second barrier end surface 342 is located on a different horizontal plane from the second suction nozzle end face 332 and protrudes from the second suction nozzle end face 332, that is, being higher than the horizontal plane of the second barrier end surface 332. In this embodiment, the second barrier end surface 342 and the first barrier end surface 341 are of curved structures and are connected through a curved transition. Due to the bump of the barrier block 34, the second barrier end surface 342 and the first barrier end surface 341 are of a wholly curved structure. When the barrier block 34 of the curved structure rotates with the rotating member and the suction nozzle 33 as a whole, through the curved surfaces of the first barrier end surface 341 and second barrier end surface 342 and the cover body part 11 located below; the curved path movement is carried out. The curved path movement assists the rotation of the rotating member 32 and the suction nozzle 33. In this case, once the first conduit channel 31 and the second barrier end surface 13 do not allow flow; the barrier block 34 blocks at any time the beverage in the container 200 from flowing outward through the second conduit channel 13. In addition, the curved surfaces of the first barrier end surface 341 and the second barrier end surface 342 contact or abut against the water outlet at the upper end of the second conduit channel 13, thus completely sealing it.

According to the embodiment of the present invention, as shown in the figure, the operating member 35 is disposed on the top of the rotating member 32 and protrudes from the body of the rotating member 32 to form a bump structure. The operating member 35 is located on a side far away from the suction nozzle 33, and when the suction nozzle cover 9 covers the suction nozzle 33, the tail end part of the operating member 35 protrudes the outer wall 14 of the cover body 1 and is located outside it. In this embodiment, the outer peripheral surface of the cover body part 11 is provided with a curved part 113. The outer tail end of the operating member 35 is provided with a curved extension part 353. The extension part 353 is located on substantially the same arc as the curved part 113. When the second drinking spout 3 is closed, the curved edge 114 of the curved part 113 transitions to the extension edge 354 of the extension part 353 in a circular curve of equal curvature. When the second drinking spout 3 of the operating member 35 is opened or closed, the external circular curves of the entire cup cover are exactly aligned, making the cup look better. In this embodiment, the operating member 35 faces from a joint with the rotating member 32 toward a direction of its outer end, that is, the free end. The top of the operating member 35 is disposed at an increasingly large inclined angle, making it convenient and easy for the user to apply force and operate when acting on the operating member 35 with one hand.

According to this embodiment of the present invention, the top of the operating member 35 is disposed as an operation surface, which is an end surface on which the user applies a force. The bottom of the operating member 35, that is, the lower end surface, is provided with a limit block. The outer wall 14 of the cover body part 11 is formed with a limit region 141. The arrangement direction of the limit region 141 is consistent with the depth direction of the container 200. When the second drinking channel 36 is configured to allow the beverage in the container 200 to flow, the rotating member 32 abuts against the limit surface of the limit region 141 through the limit block to limit the continuous rotation of the rotating member 32 along the direction of the first centerline, thus ensuring an angle of the suction nozzle 33 conducive to drinking by the user. In this embodiment, the limit region 141 is a region concaved inward from the cover body part 11. The outer end face of the limit region 141 forms the limit end face 161. The limit end face 161 is substantially parallel to the first centerline 4. The outer end of the limit block has a plane fitting the limit end face 161, thus limiting position by abutting and contacting.

According to this embodiment of the present invention, the second drinking spout 3 is provided with an absorption structure 8. Specifically, the absorption structure 8 is disposed at a position between the suction nozzle 33 and the operating member 35. The position can be of a planar structure and cannot affect the use of the suction nozzle 33 or the operation of the operating member 35 in use. The absorption structure 8 of this embodiment extends along an outer end face of the rotating member 32, that is, the top, the outer end face of the absorption structure 8 is configured as a planar structure fitting an end surface of the drinking spout cover 7 and configured for placement of the drinking spout cover 7 when the first drinking spout cover 7 is separated from the drinking spout. The absorption structure 8 in this embodiment includes a mounting member 81 and a first magnetic member 82 in the mounting member 81. The mounting member 81 is provided with a first mounting chamber 811 for mounting the first magnetic member 82. As shown in the figure, a first opening part 813 is provided in a direction of the first mounting chamber 811 close to the suction nozzle 33. The first magnetic member 82 is put in or taken out of the chamber formed inward. When the first magnetic member 82 is mounted in the first mounting chamber 811, the outer end face, that is, the upper end surface of the mounting member 81 is disposed closer to the mounting member 82 and allows the structure on the outer end face to sense the attracting force. The outer end face of the mounting member 81 is provided as an adsorbing positioning surface 812, where the suction nozzle cover 7 is absorbed on the absorbing positioning surface 812 for positioning.

In this embodiment, the outer end face of the drinking spout cover 7 is provided as a planar structure fitting an end surface of the absorption structure 8. An upper part close to the top surface of the drinking spout cover 7 is provided with a second mounting chamber 73 and configured for mounting the second magnetic member 74. The outer end face of the drinking spout cover 7 is close to the second magnetic member 74 and allows the structure on the outer end face to sense the attracting force. The outer end face of the drinking spout cover 7 is provided as an absorbing combining surface 75. The drinking spout cover 7 abuts against the absorbing positioning surface 812 through the absorbing combining surface 75 so as to place and position the drinking spout cover 7 being separated from the first drinking spout 2, thus resolving the defect in the prior art that when used, the drinking spout cover 7 needs to be held by hand or falls off and thus gets lost. In this embodiment, the drinking spout cover 7 includes an inner cover 71 and an outer cover 72. The second mounting chamber 73 is disposed in a gap formed between the inner cover 71 and the outer cover 72. The second magnetic member 74 is located in the second mounting chamber 73 for positioning. A top end of the second magnetic member 74 closer to the outer cover 72 forms an absorbing combining surface 75, thus better performing absorption and positioning with the absorption structure 8. The inner cover 71 and the outer cover 72 in this embodiment are detachably connected. The upper part of the outer cover 72 is provided with the second mounting chamber 73 in this embodiment for placing and mounting the second magnetic member 74, and a cavity combination region 76 is provided between the inner cover 71 and the outer cover 72. When the drinking spout cover 7 in this embodiment is combined with the first drinking spout 2, the inner cover 71 is located in the channel of the first drinking spout 2, that is, the first drinking channel. In addition, the inner cover is provided with an external thread, which is correspondingly combined with the internal thread on the inner wall of the upper part of the first drinking channel. The outer cover fits over the outer wall of the first drinking spout 2 and is combined with the first drinking spout 2. In this case, the cavity combination region 76 accommodates and encloses the body of the first drinking spout 21, thus completely sealing the first drinking spout 2.

According to an embodiment of the present invention, a cup cover with two drinking spouts of a beverage container 200 is used as an example, including the cup cover 100 with two spouts and the straw 300. The cup cover with two spouts includes a cover body 1 provided with a cover body part 11 and a combination part 12 extending from the cover body part 11. The cover body 1 is detachably disposed on the container 200 through the combination part 12. The cover body 1 has a first centerline 4 parallel to a depth direction of the container 200. The cup cover with two spouts includes a first drinking spout 2 extending outward along a top of the cover body part 11 and located on one side of the first centerline 4. The first drinking spout 2 is provided with a first drinking channel 26 through which a beverage in the container 200 flows, the first drinking channel 26 runs through the cover body part 11 and communicates with the container 200, and the first drinking spout 2 is provided with a detachably connected drinking spout cover 7 configured for opening or closing the first drinking channel 26. The cup cover with two spouts further includes a second drinking spout 3, located at the other side of the first centerline 4, far away from the first drinking spout 2. The second drinking spout 3 is provided with a first conduit channel 31, the cover body 1 is provided with a second conduit channel 13 running through the cover body part 11, and the first conduit channel 31 and the second conduit channel 13, when communicating with each other, form a second drinking channel 36 through which the beverage in the container 200 flows. The second drinking spout 3 has one side provided with a barrier block 34 and the corresponding other side provided with an operating member 35 that drives the second drinking spout 3 to press on the cover body 1 or to be separated from the cover body 1. When the second drinking spout 3 rotates with respect to the cover body 1 until the second drinking spout 3 abuts against an upper part of the cover body part 11, a lower end of the first conduit channel 31 is far away from an upper end of the second conduit channel 13, being spaced apart from the second conduit channel 13, the barrier block 34 abuts against an upper part of the second conduit channel 13, the second conduit channel 13 does not allow flow; and therefore the second drinking spout 3 is in a closed state. The cup cover with two spouts further includes a straw 300 detachably connected to a lower end of the second conduit channel 36, the straw 300 being in non-contact communication with or disconnection from the second drinking spout 3. Specifically, the upper end of the straw 300 is detachably connected to the lower end of the second conduit channel 13. The straw 300 is in non-contact communication or disconnection from the first conduit channel 31. When the beverage in the straw 300 needs to reach into the suction nozzle 33 and pass through the suction nozzle 33 for drinking, the second conduit channel 13 in the middle needs to be connected and the upper part of the straw 300 is indirectly connected to the water inlet of the suction nozzle 33.

According to an embodiment of the present invention, a seal ring is provided between the cover body 1 and the container 200 to completely seal the container 200, thus preventing the beverage therein from spilling. The detachable connection between the cover body 1 and the container 200 may be a threaded connection, a buckle connection, a press and retract connection, or the like, which is not limited to the manner shown in the accompanying drawings of this embodiment. The drinking utensil is provided with two drinking channels, that is, two drinking ways, thus realizing the versatility of drinking. For example, if the time is limited or the user needs to drink urgently, it is more efficient to drink through the first drinking spout 2. If the cup is used by children or there is plenty of time, drinking can be performed using the straw 300 of the second drinking spout 3. A drinking utensil can be shared based on the requirements of, for example, scenario, time, or parent-child relationship.

The suction nozzle 33 of this embodiment can be made of an elastic material or a non-soft material. When the suction nozzle 33 switches between the use and non-use state, that is, the suction nozzle 33 is opened or closed, it does not need to deform, thus implementing the storage or opening relative to the cover body 1, and opening and closing are implemented through the rotating member 32 and the suction nozzle cover 9.

In the drinking utensil, as shown in FIGS. 15 to 18, the second drinking spout 3 communicates with the straw 300 in the container 200 through the cover body 1. When the user needs to drink the beverage in the container 200, the beverage in the container 200 can be sucked to enter the second conduit channel 13 on the cover body 1 through the straw 300 and then flow out of the suction nozzle 33 of the second drinking spout 3. Because the suction drinking function through the second drinking channel 36 in this embodiment is implemented by indirect or non-contact connection between the suction nozzle 33 and the straw 300, the suction nozzle 33 can be disposed at a large inclined angle to the cover body 1 or the container 200, such that the beverage in the container 200 can be drunken through the suction nozzle 33 when the container 200 is not inclined, that is, is disposed vertically on a desk and other use media, which greatly facilitates the use. In this embodiment, for better drinking use of the second drinking channel 36, that is, easier beverage drinking, a ventilation component 10 is also provided on a top wall of the cover body 1 and runs through the top wall. In addition, the ventilation component 10 is located around the second drinking spout 3. Preferably, the ventilation component 10 is provided on the cover body 1 corresponding to the placement end surface 162 of the mounting chamber 16. Even if when the container is inclined, water does not leak from the ventilation component 10 which allows only the air to pass for better drinking.

Figure 11:
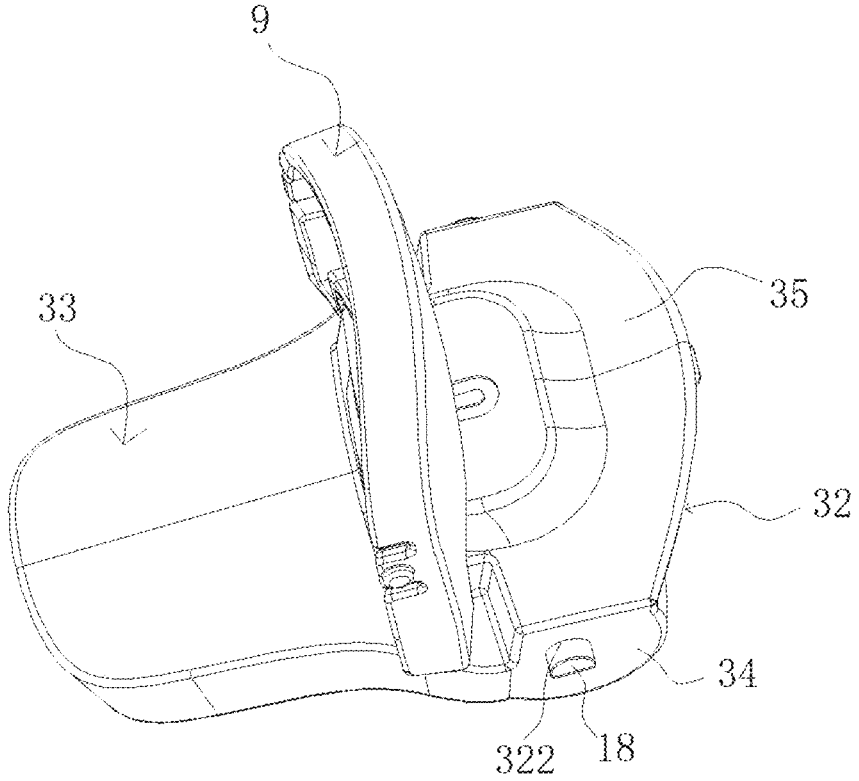
FIG. 11 is a first schematic structural diagram of an opened second drinking spout according to an embodiment of the present invention.
Figure 12:
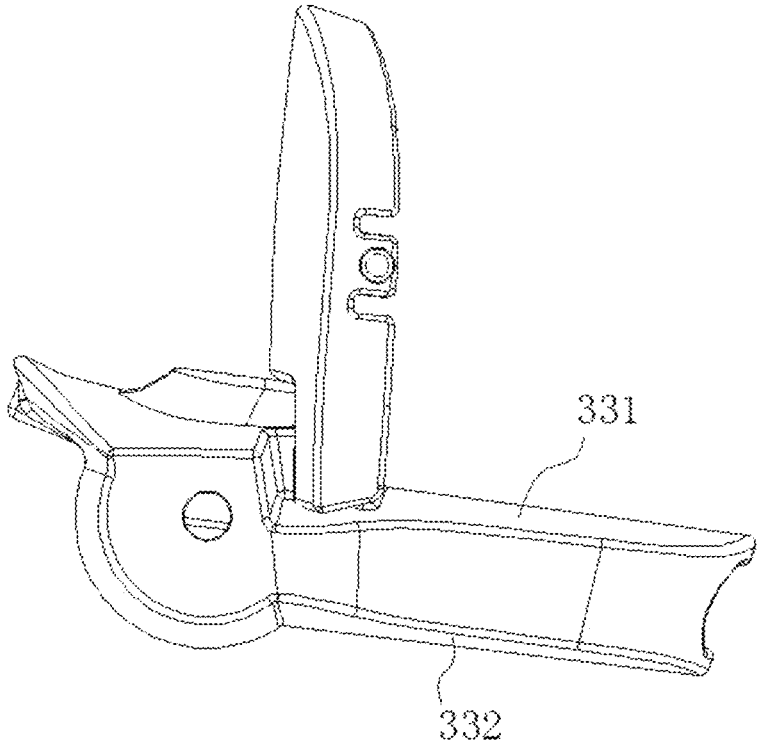
FIG. 12 is a second schematic structural diagram of an opened second drinking spout according to an embodiment of the present invention.
Figure 13:
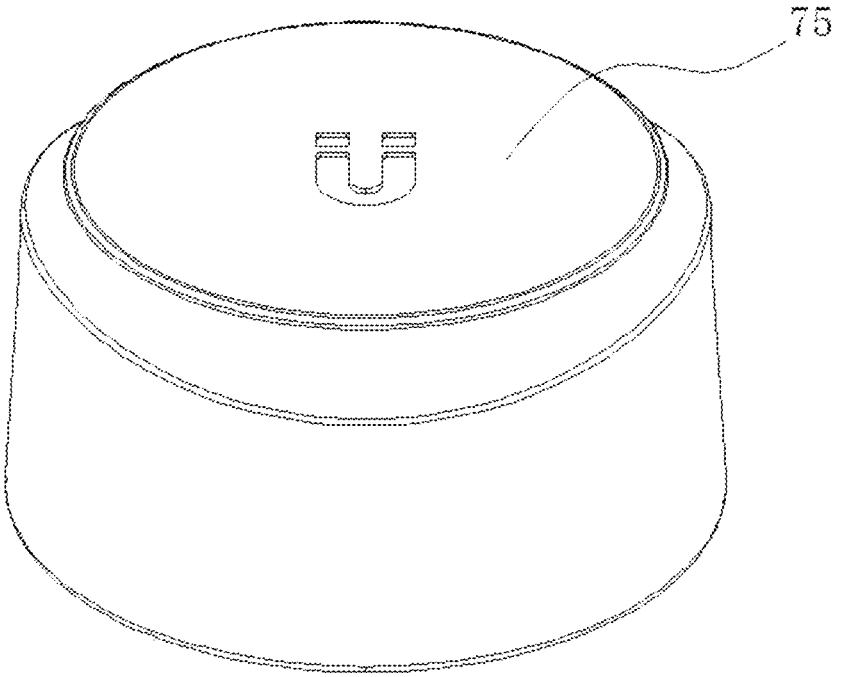
FIG. 13 is a schematic structural diagram of a drinking spout cover according to an embodiment of the present invention.
Figure 14:
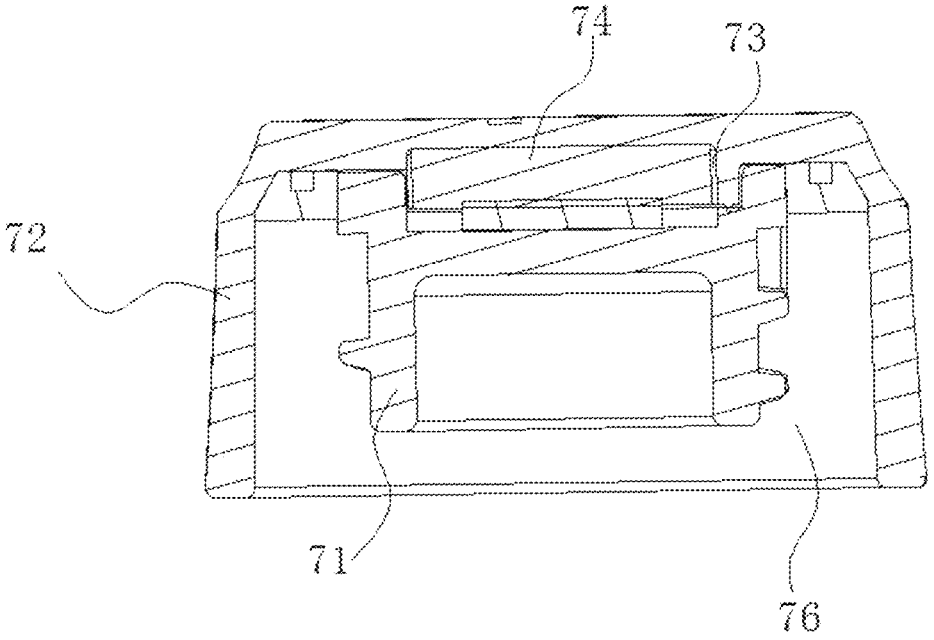
FIG. 14 is a cross-sectional view of a drinking spout cover according to an embodiment of the present invention.
Figure 15:
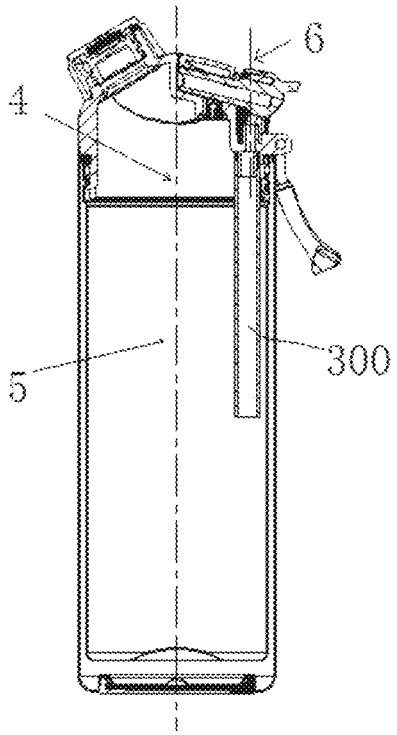
FIG. 15 is a cross-sectional view of a closed second drinking spout of a drinking utensil according to the present invention.
Figure 16:
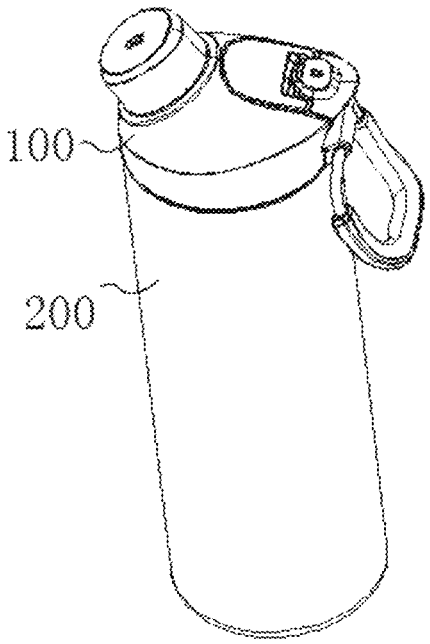
FIG. 16 is a schematic structural diagram of a closed second drinking spout of a drinking utensil according to the present invention.
Figure 17:
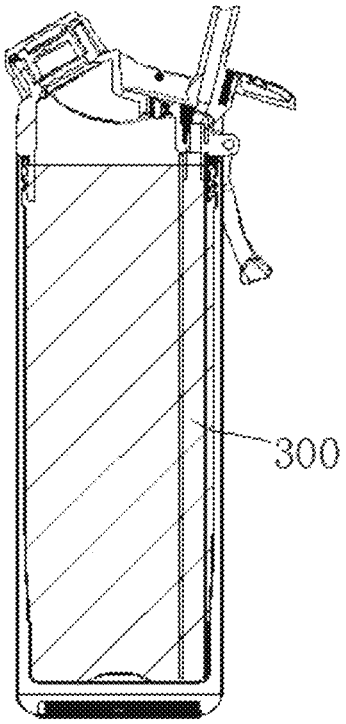
FIG. 17 is a cross-sectional view of an opened second drinking spout of a drinking utensil according to the present invention.
Figure 18:
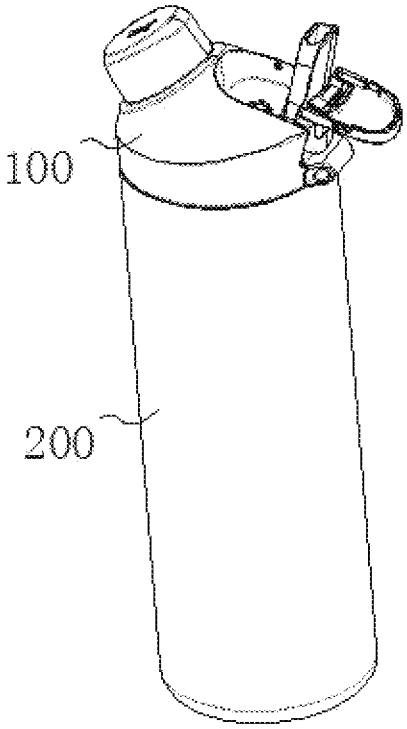
FIG. 18 is a schematic structural diagram of an opened second drinking spout of a drinking utensil according to the present invention.

In this embodiment, as shown in FIGS. 11 and 12, the suction nozzle cover 9 is rotatably mounted on the rotating member 32. When the suction nozzle 33 needs to be used for drinking, the user presses the operating member 35 or does other operations, the rotating member 32, the suction nozzle 33, and the suction nozzle cover 9 that are included as a whole in the second drinking spout 3 rotate with respect to the cover body 1 to leave the mounting chamber 16. After the relative rotation of the rotating member 32, suction nozzle 33, and suction nozzle cover 9 to a position, the suction nozzle cover 9 is operated manually and the suction nozzle cover 9 rotates to a position with respect to the rotating member 32, such that the user sucks the beverage in the container 200 through the suction nozzle 33. The suction nozzle cover 9 in this embodiment includes a cover part 91 and a connection arm 92 connected to the cover part 91. The connection arm 92 is provided with a first hole 93, and a corresponding mounting member 81 is provided with a second hole 815. The connection arm 92 and the rotating member 32 are connected through a second rotation shaft and rotate with respect to each other. In addition, the connection positions, that is, the second holes 815 are disposed on the absorption structure 8, that is, at two sides of the mounting member 81. The mounting member 81 protrudes from the body of the rotating member and extends outward. The mounting member 81 also protrudes from the drinking spout, that is, the absorbing positioning surface 812 is horizontally higher than the top surface of the drinking spout. In addition, opposites inner walls of the mounting member 81 are concaved inward with respect to the outside of the rotating member 32 to form mounting stand surfaces 816. The two connection arms 92 of the suction nozzle cover 9 are respectively located in the mounting stand surfaces 816 and connected to the rotating member 32. In other words, the lower end of the connection arm 92 is supported and borne by the mounting stand surface 816, thus placing the suction nozzle cover 9 more stably. In the same way, the drinking spout cover 7 is placed on the rotating member 32, that is, the drinking spout cover 7 is located in a region between the two connection arms 92 of the suction nozzle cover 9, which will not interfere with the placement of the suction nozzle 33 and the use of the first drinking spout 2.

In this embodiment, the container 200 used correspondingly for the drinking utensil may be of an insulation structure or of a glass or plastic structure. This falls into the range of a combination of matchable and usable covers in this embodiment.

In short, only the above-mentioned invention of the present invention mentioned above is that the equal change and modification of the patent scope of the application of this invention shall be the coverage of the patent of the invention.

What is claimed is:

1. A cup cover with two drinking spouts, comprising:

a cover body provided with a cover body part and a combination part extending from the cover body part, wherein the cover body is detachably disposed on a container through the combination part, and the cover body has a first centerline parallel to a depth direction of the container;

a first drinking spout extending outward along a top of the cover body part and located on one side of the first centerline, wherein the first drinking spout is provided with a first drinking channel through which a beverage in the container flows, the first drinking channel runs through the cover body part and communicates with the container, the first drinking spout is provided with a detachably connected drinking spout cover configured for opening or closing the first drinking channel;

a second drinking spout, located at the other side of the first centerline, away from the first drinking spout, wherein the second drinking spout is provided with a first conduit channel, the cover body is provided with a second conduit channel running through the cover body part, and the first conduit channel and the second conduit channel, when communicating with each other, form a second drinking channel through which the beverage in the container flows; the second drinking spout has one side provided with a barrier block and the corresponding other side provided with an operating member that drives the second drinking spout to press on the cover body or to be separated from the cover body; and when the second drinking spout rotates with respect to the cover body until the second drinking spout abuts against an upper part of the cover body part, a lower end of the first conduit channel is far away from an upper end of the second conduit channel, being spaced apart from the second conduit channel, the barrier block abuts against an upper part of the second conduit channel, the second conduit channel does not allow flow, and therefore the second drinking spout is in a closed state;

the second drinking spout is provided with an absorption structure, the absorption structure extends along an outer end face of a rotating member, the outer end face of the absorption structure is configured as a planar structure fitting an end surface of a first drinking spout cover and configured for placement of the first drinking spout cover when the first drinking spout cover is separated from the drinking spout; and wherein the absorption structure is configured as a magnetic member, the second drinking spout is provided with a first mounting chamber configured for mounting the magnetic member, and the outer end face of the absorption structure is close to the magnetic member and is capable of allowing a structure on the outer end face to sense an attracting force.

2. The cup cover with two drinking spouts according to claim 1, wherein an outer end face of the first drinking spout cover is configured as a planar structure fitting an end surface of the absorption structure, an upper part of the first drinking spout cover close to a top surface is provided with a second mounting chamber configured for mounting the magnetic member, and the outer end face of the first drinking spout cover is close to the magnetic member and is capable of allowing a structure on the outer end face to sense an attracting force.

3. The cup cover with two drinking spouts according to claim 1, further comprising: wherein the second drinking spout comprises a rotating member and a suction nozzle, wherein a suction nozzle cover configured to cover the entire suction nozzle is disposed above the suction nozzle, the barrier block is disposed on the rotating member and is located on a side away from the suction nozzle cover, the second drinking spout and the suction nozzle cover are capable of rotating as a whole with respect to the cover body, wherein the second drinking spout and the suction nozzle cover rotate until the lower end of the first conduit channel communicates with the upper end of the second conduit channel, such that the beverage in the container flows, the barrier block is located on an inner side of a second centerline, the suction nozzle is disposed at an angle with the second center line, and the suction nozzle is located outside the second center line and close to an outer wall of the cover body.

4. The cup cover with two drinking spouts according to claim 3, further comprising: wherein the suction nozzle has a first suction nozzle end face and a second suction nozzle end face that are opposite each other, the suction nozzle cover when closed is located on the first suction nozzle end face, the barrier block has a first barrier end surface and a second barrier end surface that are connected through a curved transition, the second barrier end surface of the barrier block and the second suction nozzle end face are located on a same side, and a highest point of the second barrier end surface is located on a different horizontal plane from the second suction nozzle end face and protrudes from the second suction nozzle end face; and the second suction nozzle end face is of a curved structure.

5. The cup cover with two drinking spouts according to claim 4, wherein the rotating member is provided with a first through hole, the first through hole running through the rotating member from a first barrier end surface along a length direction of the suction nozzle, and the suction nozzle is provided with a second through hole, wherein the first through hole and the second through hole form the first conduit channel, and the first through hole has a water inlet end in communication with the second conduit channel and a water outlet end in communication with the second through hole.

6. The cup cover with two drinking spouts according to claim 5, wherein a diameter of the second through hole is configured greater than or equal to a diameter of the first through hole; and the diameter of the second through hole is configured greater than or equal to a diameter of the second conduit channel.

7. The cup cover with two drinking spouts according to claim 6, wherein when the second drinking channel allows or does not allow flow, centers of the first through hole and the second through hole are on a same straight line.

8. The cup cover with two drinking spouts according to claim 3, wherein the rotating member is disposed on a top wall of the cover body part away from the first centerline, a suction nozzle cover is disposed on the rotating member and pivotally connected to the rotating member, and when a force is applied to the operating member, the rotating member, a suction nozzle cover, and the suction nozzle are moved as a whole from a mounting chamber.

9. The cup cover with two drinking spouts according to claim 1, wherein the operating member is disposed on a top of the rotating member and extends from a body of the rotating member to form a bump structure, and the operating member is located on a side away from a suction nozzle; and when a suction nozzle cover covers the suction nozzle, a tail end part of the operating member protrudes from an outer wall of the cover body and is located outside the cover body.

10. The cup cover with two drinking spouts according to claim 9, wherein an outer peripheral surface of the cover body part has a curved part, and an outer tail end of the operating member is configured as a circular curved extension part, the extension part and the curved part being basically on a same curve line.

11. The cup cover with two drinking spouts according to claim 10, wherein a lower end surface of the operating member is provided with a limit block, an outer wall of the cover body part is formed with a limit region, and when the second drinking channel is configured to allow the beverage in the container to flow, the rotating member abuts against a limit end face of the limit region through the limit block which is configured to limit continuous rotation of the rotating member in a direction of a first center.

12. The cup cover with two drinking spouts according to claim 11, wherein the limit region is a region concaved inward from the cover body, an outer end face of the limit region forms a limit end face, and the limit end face is disposed parallel to the first centerline; and an outer end of the limit block has a plane fitting the limit end face.

13. The cup cover with two drinking spouts according to claim 9, wherein the top of the cover body part is provided with a mounting chamber configured for mounting and accommodating the second drinking spout, the mounting chamber has a tilting ramp and is provided with a limit end and a free end, the limit end being higher than the free end, and the free end of the mounting chamber runs through an outer end of the cover body part; and a free space is formed between the free end and a mounting end surface of the mounting chamber and taken as a movement path required by the rotation of the barrier block and the operating member when the suction nozzle is covered and opened.

14. A drinking utensil, comprising:

a cup cover with two drinking spouts, further comprising:

a cover body provided with a cover body part and a combination part extending from the cover body part, wherein the cover body is detachably disposed on a container through the combination part, and the cover body has a first centerline parallel to a depth direction of the container;

a first drinking spout extending outward along a top of the cover body part and located on one side of the first centerline, wherein the first drinking spout is provided with a first drinking channel through which a beverage in the container flows, the first drinking channel runs through the cover body part and communicates with the container, the first drinking spout is provided with a detachably connected drinking spout cover configured for opening or closing the first drinking channel; and a second drinking spout, located at the other side of the first centerline, far away from the first drinking spout, wherein the second drinking spout is provided with a first conduit channel, the cover body is provided with a second conduit channel running through the cover body part, and the first conduit channel and the second conduit channel, when communicating with each other, form a second drinking channel through which the beverage in the container flows; the second drinking spout has one side provided with a barrier block and the corresponding other side provided with an operating member that drives the second drinking spout to press on the cover body or to be separated from the cover body; and when the second drinking spout rotates with respect to the cover body until the second drinking spout abuts against an upper part of the cover body part, a lower end of the first conduit channel is far away from an upper end of the second conduit channel, being spaced apart from the second conduit channel, the barrier block abuts against an upper part of the second conduit channel, the second conduit channel does not allow flow, and therefore the second drinking spout is in a closed state;

a container configured to hold a beverage, wherein the cup cover is detachably connected to the container; and a drinking spout cover comprises an inner cover and an outer cover, wherein a second mounting chamber is formed between the inner cover and the outer cover and is configured for mounting and positioning a second magnetic member, and a top end of the second magnetic member close to the outer cover forms an absorption combination surface; and the inner cover and the outer cover are provided with a cavity combination region, when the drinking spout cover is combined with the first drinking spout, the inner cover is located in a channel of the first drinking spout, that is, the first drinking channel, the outer cover is sleeved on an outer wall of the first drinking spout and is combined with the first drinking spout, and the cavity combination region accommodates and surrounds the body of the first drinking spout, such that the first drinking spout is sealed completely.

* * * * *